US008958585B2

(12) United States Patent
Yamada et al.

(10) Patent No.: US 8,958,585 B2
(45) Date of Patent: Feb. 17, 2015

(54) SOUND IMAGE LOCALIZATION APPARATUS

(75) Inventors: Yuji Yamada, Tokyo (JP); Koyuru Okimoto, Tokyo (JP)

(73) Assignee: Sony Corporation (JP)

( * ) Notice: Subject to any disclaimer, the term of this patent is extended or adjusted under 35 U.S.C. 154(b) by 1597 days.

(21) Appl. No.: 11/155,369

(22) Filed: Jun. 17, 2005

(65) Prior Publication Data

US 2005/0286726 A1 Dec. 29, 2005

(30) Foreign Application Priority Data

Jun. 29, 2004 (JP) ..... P2004-191953

(51) Int. Cl.
*H04R 5/02* (2006.01)
*H04R 5/00* (2006.01)
*H04S 1/00* (2006.01)

(52) U.S. Cl.
CPC ..... *H04S 1/00* (2013.01)
USPC ..... 381/310; 381/1

(58) Field of Classification Search
USPC ..... 381/310
See application file for complete search history.

(56) References Cited

U.S. PATENT DOCUMENTS 5,095,507 A * 3/1992 Lowe ..... 381/17
5,173,944 A * 12/1992 Begault ..... 381/17
5,371,799 A * 12/1994 Lowe et al. ..... 381/310
5,572,591 A * 11/1996 Numazu et al. ..... 381/1
6,175,631 B1 * 1/2001 Davis et al. ..... 381/17
7,536,021 B2 * 5/2009 Dickins et al. ..... 381/310
7,706,555 B2 * 4/2010 Kawano et al. ..... 381/310

FOREIGN PATENT DOCUMENTS

JP 05-165485 A 7/1993
JP 05-59499 A 8/1993
JP 06-022399 A 1/1994
JP 07-319483 A 12/1995
JP 2000-069599 A 3/2000
JP 2000-138998 A 5/2000
JP 2000-227350 A 8/2000
JP 2002-044797 A 2/2002
JP 2002-262398 A 9/2002
JP 2002-345096 A 11/2002
WO WO 9914983 A1 * 3/1999 ..... H04R 5/33

* cited by examiner

*Primary Examiner* — Duc Nguyen
*Assistant Examiner* — Kile Blair
(74) *Attorney, Agent, or Firm* — Lerner, David, Littenberg, Krumholz & Mentlik, LLP

(57) ABSTRACT

Multiple independent sound images are formed by integrally performing uncorrelation processing and sound image localization processing on an input audio signal with signal processors that use output functions hl(x) and hr(x) obtained by integrating an uncorrelation function that generate multiple audio signals with low mutual correlation from an input audio signal. The signal processors have a sound image localization function for localizing the sound image of each of the multiple audio signals at a given sound source position.

8 Claims, 19 Drawing Sheets

SOUND IMAGE LOCALIZATION APPARATUS

CROSS REFERENCES TO RELATED APPLICATIONS

The present invention contains subject matter related to Japanese Patent Application JP2004-191953 filed in the Japanese Patent Office on Jun. 29, 2004, the entire contents of which being incorporated herein by reference.

BACKGROUND OF THE INVENTION

1. Field of the Invention

The present invention relates to a sound image localization apparatus and is preferably applied to the case where a sound image reproduced with a headphone, for example, is localized at a given position.

2. Description of the Related Art

When an audio signal is supplied to a speaker and reproduced, a sound image is localized ahead of a listener. On the other hand, when the same audio signal is supplied to a headphone unit and reproduced, a sound image is localized within the listener's head, and thereby an extremely unnatural sound field is created.

In order to improve the unnatural localization of a sound image in a headphone unit, there has been proposed a headphone unit adapted to enable, by measuring or calculating impulse responses from a given speaker position to both ears of a listener and by reproducing audio signals with the impulse responses convoluted therein with the use of a digital filter or the like, realization of localization of a natural sound image outside the head as if the audio signals were reproduced from a real speaker (see Japanese Patent Laid-Open No. 2000-227350, for example).

FIG. 1 shows the configuration of a headphone unit 100 for localizing a sound image of an audio signal of one channel outside the head. The headphone unit 100 digitally converts an analog audio signal SA of one channel inputted via an input terminal 1 by an analog/digital conversion circuit 2 to generate a digital audio signal SD, and supplies it to digital processing circuits 3L and 3R. The digital processing circuits 3L and 3R performs signal processing for localization outside the head, on the digital audio signal SD.

As shown in FIG. 2, when a sound source SP at which a sound image is to be localized is located in front of a listener M, a sound outputted from the sound source SP reaches the left and right ears of the listener M via paths with transfer functions HL and HR. The impulse responses of the left and right channels with the transfer functions HL and HR converted to time axes are measured or calculated in advance.

The digital processing circuits 3L and 3R convolute the above-described left-channel and right-channel impulse responses in the digital audio signal SD, respectively, and outputs the obtained signals as digital audio signals SDL and SDR. The digital processing circuits 3L and 3R are configured by a finite impulse response (FIR) filter as shown in FIG. 3.

Digital/analog conversion circuits 4L and 4R analogously convert the digital audio signals SDL and SDR to generate analog audio signals SAL and SAR, respectively, amplify the analog audio signals with corresponding amplifiers 5L and 5R and supply them to a headphone 6. Acoustic units (electric/acoustic conversion devices) 6L and 6R of the headphone 6 convert the analog audio signals SAL and SAR to sounds, respectively, and output the sounds.

Accordingly, the left and right reproduced sounds outputted from the headphone 6 are equal to the sounds which have reached from a sound source SP shown in FIG. 2 via the paths with the transfer functions HL and HR. Thereby, when the listener equipped with the headphone 6 listens to the reproduced sounds, the sound image is localized at the position of the sound source SP shown in FIG. 2 (namely, outside the head).

SUMMARY OF THE INVENTION

The above description has been made on the case of one sound image. By providing multiple above-described configurations, it is possible to localize each of multiple sound images at a different sound source position.

Description will be made with the use of FIG. 5 on a multichannel-enabled headphone unit 101 for localizing a sound image at each of two positions of a sound source SPa in the left front of a listener and a sound source SPb in the right front as shown in FIG. 4, for example. Impulse responses of transfer functions HaL and HaR from the left-forward sound source SPa to both ears of the listener M and transfer functions HbL and HbR from the right-forward sound source SPb to both ears of the listener M converted to time axes are measured or calculated in advance.

In FIG. 5, an analog/digital conversion circuit 2*a* of the headphone unit 101 digitally converts an analog audio signal SAa inputted via an input terminal 1*f* to generate a digital audio signal SDa, and supplies it to subsequent-stage digital processing circuits 3*a*L and 3*a*R. Similarly, an analog/digital conversion circuit 2*b* digitally converts an analog audio signal SAb inputted via an input terminal 1*b* to generate a digital audio signal SDb, and supplies it to subsequent-stage digital processing circuits 3*b*L and 3*b*R.

The digital processing circuits 3*a*L and 3*b*L convolute impulse responses to the left ear in digital audio signals SDa and SDb, respectively, and supply the digital audio signals to an addition circuit 7L as digital audio signals SDaL and SDbL. Similarly, the digital processing circuits 3*a*R and 3*b*R convolute impulse responses to the right ear in digital audio signals SDa and SDb, respectively, and supply the signals to the addition circuit 7R as digital audio signals SDaR and SDbR. Each of the digital processing circuits 3*a*L, 3*a*R, 3*b*L and 3*b*R is configured by the FIR filter shown in FIG. 3.

The addition circuit 7L adds the digital audio signals SDaL and SDbL with impulse responses convoluted therein to generate a left-channel digital audio signal SDL. Similarly, the addition circuit 7R adds the digital audio signals SDaR and SDbR with impulse responses convoluted therein to generate a right-channel digital audio signal SDR.

The digital/analog conversion circuits 4L and 4R analogously convert the digital audio signals SDL and SDR to generate analog audio signals SAL and SAR, respectively, amplify the analog audio signals with the corresponding amplifiers 5L and 5R and supply them to the headphone 6. The acoustic units 6L and 6R of the headphone 6 convert the analog audio signals SAL and SAR to sounds, respectively, and output the sounds.

Left and right reproduced sounds outputted from the headphone 6 are equal to sounds which have reached from the front-left sound source SPa shown in FIG. 4 via the paths with the transfer functions HaL and HaR, and equal to sounds which have reached from the front-right sound source SPb via the paths with the transfer functions HbL and HbR, respectively. Thereby, when the listener equipped with the headphone 6 listens to the reproduced sounds, sound images are localized at the positions of the front-left sound source SPa and the front-right sound source SPb.

There is a multichannelizing apparatus which pseudoly generates audio signals of multiple channels from one audio signal with the use of multiple uncorrelation filters or band-pass filters.

It is conceivable that, by combining this multichannelizing apparatus with the multichannel-enabled headphone unit 101 described above, a headphone unit can be realized which can form multiple sound images based on one audio signal. Actually, however, uncorrelation filters or digital processing circuits of the number corresponding to the number of sound images may be required, which causes a problem that the scale of the entire apparatus is large.

The present invention has been made in consideration of the above problem, and intends to propose a sound image localization apparatus capable of forming multiple independent sound images to enable a user to listen thereto in simple configuration.

According to the present invention, there is provided a sound image localization apparatus for generating such left-channel and right-channel reproduction audio signals as cause the sound image of each of multiple audio signals with low mutual correlation generated from an input audio signal to be localized at a given sound source position, which is provided with signal processing means for performing signal processing on an input audio signal with the use of a pair of output functions obtained by integrating an uncorrelation function for generating multiple audio signals with low mutual correlation from the input audio signal and a sound image localization function for localizing the sound image of each of the multiple audio signals at a given sound source position, to generate left-channel and right-channel audio signals for reproduction.

By integrally performing uncorrelation processing and sound image localization processing on an input audio signal with signal processing means, with the use of a pair of output functions obtained by integrating an uncorrelation function and a sound image localization function, it is possible to generate a reproduction audio signal capable of forming multiple independent sound images and enabling a user to listen thereto, in a simple configuration.

Further, according to the present invention, there is provided a sound image localization method for generating such left-channel and right-channel reproduction audio signals as cause the sound image of each of multiple audio signals with low mutual correlation generated from an input audio signal to be localized at a given sound source position, which includes an uncorrelation function determination step of determining an uncorrelation function for generating a plurality of audio signals with low mutual correlation from an input audio signal; a sound image localization determination step of determining a sound image localization function for localizing the sound image of each of the plurality of audio signals at a given sound source position; an output function determination function for determining a pair of output functions obtained by integrating the uncorrelation function and the sound image localization function; and a reproduction audio signal generation step of generating left-channel and right-channel audio signals for reproduction by performing signal processing on the input audio signal with the use of the pair of output functions.

By integrally performing uncorrelation processing and sound image localization processing on an input audio signal, with the use of a pair of output functions obtained by integrating an uncorrelation function and a sound image localization function, it is possible to generate a reproduction audio signal capable of forming multiple independent sound images and enabling a user to listen thereto, with a simple process.

Still further, according to the present invention, there is provided a sound image localization program for causing an information processor to execute a process of generating such left-channel and right-channel reproduction audio signals as cause the sound image of each of multiple audio signals with low mutual correlation generated from an input audio signal to be localized at a given sound source position, which includes: an uncorrelation function determination step of determining an uncorrelation function for generating a plurality of audio signals with low mutual correlation from an input audio signal; a sound image localization determination step of determining a sound image localization function for localizing the sound image of each of the plurality of audio signals at a given sound source position; an output function determination function for determining a pair of output functions obtained by integrating the uncorrelation function and the sound image localization function; and a reproduction audio signal generation step of generating left-channel and right-channel audio signals for reproduction by performing signal processing on the input audio signal with the use of the pair of output functions.

By integrally performing uncorrelation processing and sound image localization processing on an input audio signal, with the use of a pair of output functions obtained by integrating an uncorrelation function and a sound image localization function, it is possible to generate a reproduction audio signal capable of forming multiple independent sound images and enabling a user to listen thereto, with a simple process.

According to the present invention, by performing signal processing on an input audio signal with the use of a pair of output functions obtained by integrating an uncorrelation function for generating multiple audio signals with low mutual correlation from an input audio signal and a sound image localization function for localizing the sound image of each of the multiple audio signals at a given sound source position, it is possible to realize a sound localization apparatus capable of forming multiple independent sound images and enabling a user to listen thereto, in a simple configuration.

The nature, principle and utility of the invention will become more apparent from the following detailed description when read in conjunction with the accompanying drawings in which like parts are designated by like reference numerals or characters.

DETAILED DESCRIPTION OF THE PREFERRED EMBODIMENTS

Embodiments of the present invention will be described in detail with reference to drawings.

(1) First Embodiment (1-1) Entire Configuration of a Headphone Unit

Figure 1:
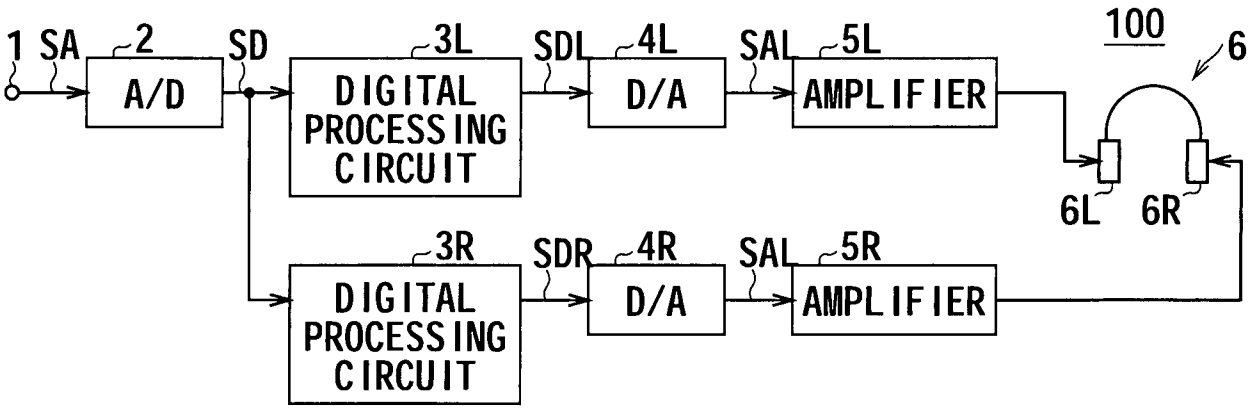
FIG. 1 (RELATED ART)
FIG. 1 is a block diagram showing the entire configuration of a headphone unit in related art.
Figure 2:
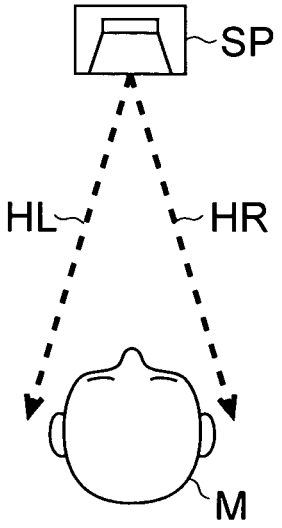
FIG. 2 (RELATED ART)
FIG. 2 is a schematic diagram to illustrate sound image localization by means of a headphone unit.
Figure 3:
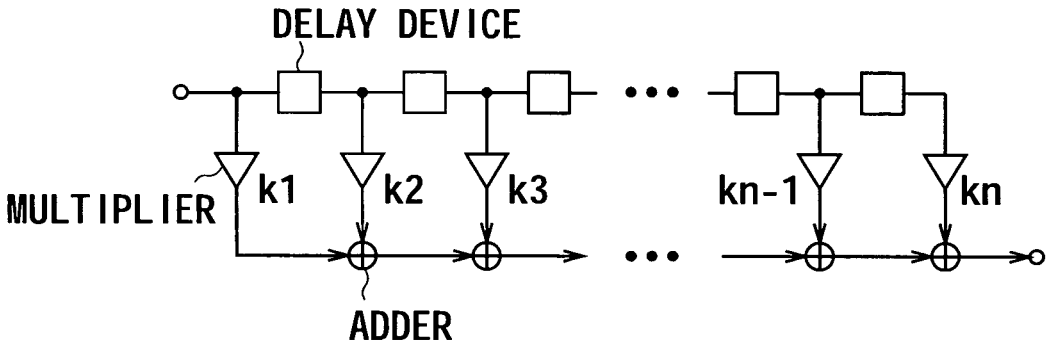
FIG. 3 (RELATED ART)
FIG. 3 is a block diagram showing the configuration of an FIR filter.
Figure 4:
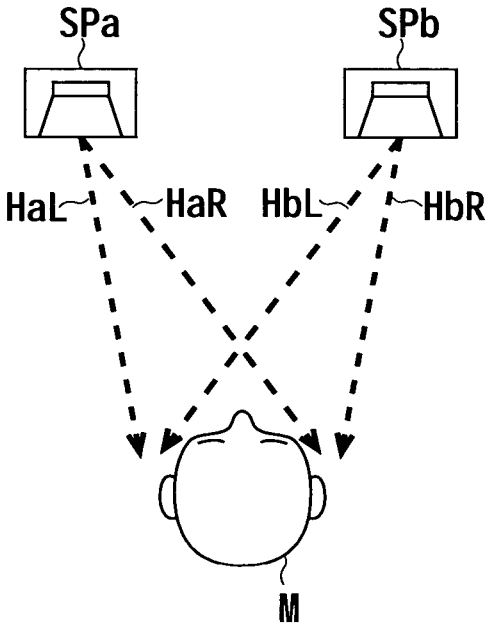
FIG. 4 (RELATED ART)
FIG. 4 is a schematic diagram to illustrate transfer functions in the case of multiple sound sources.
Figure 5:
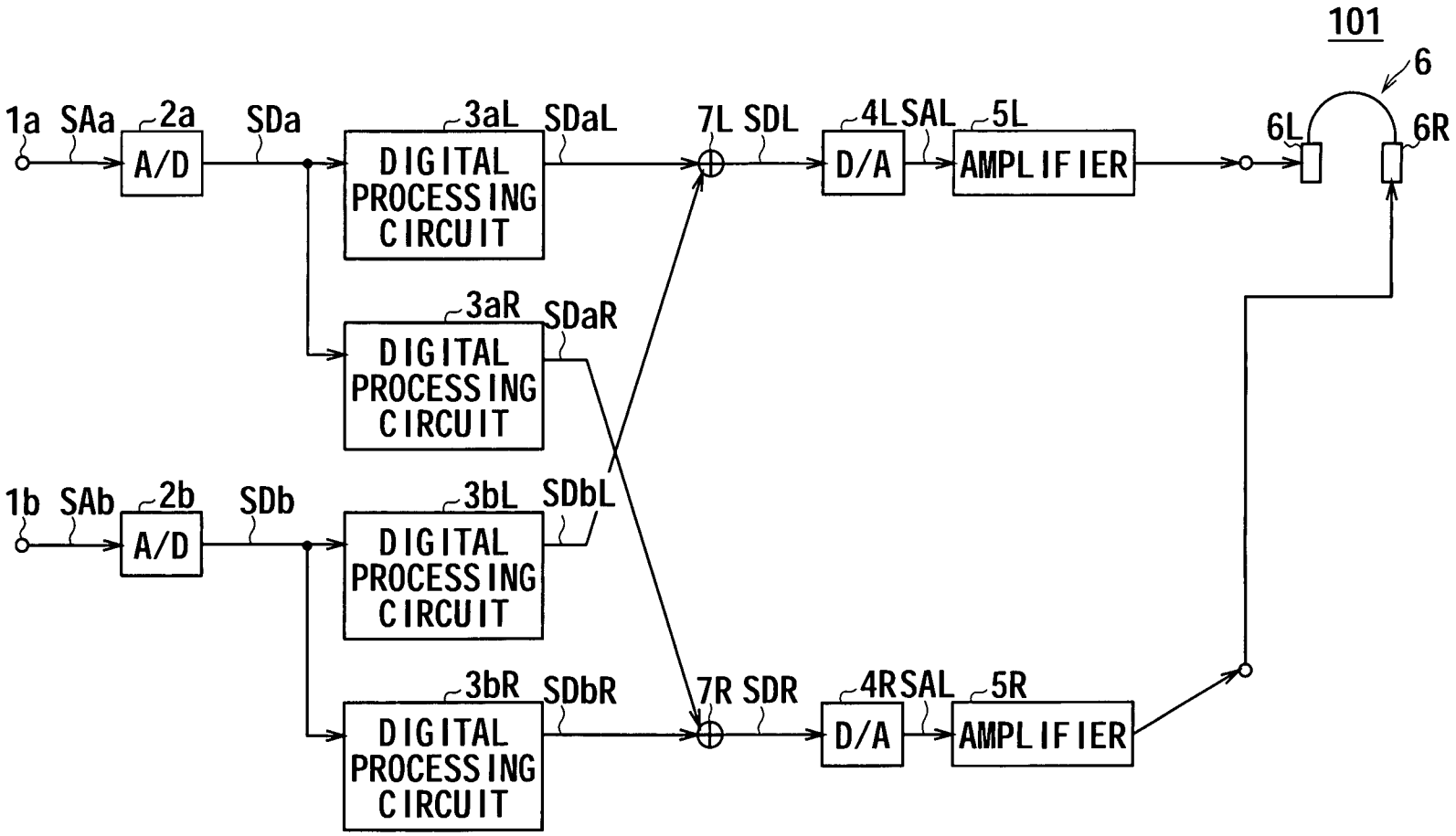
FIG. 5 (RELATED ART)
FIG. 5 is a block diagram showing the configuration of a 12-channel-enabled headphone unit.
Figure 6:
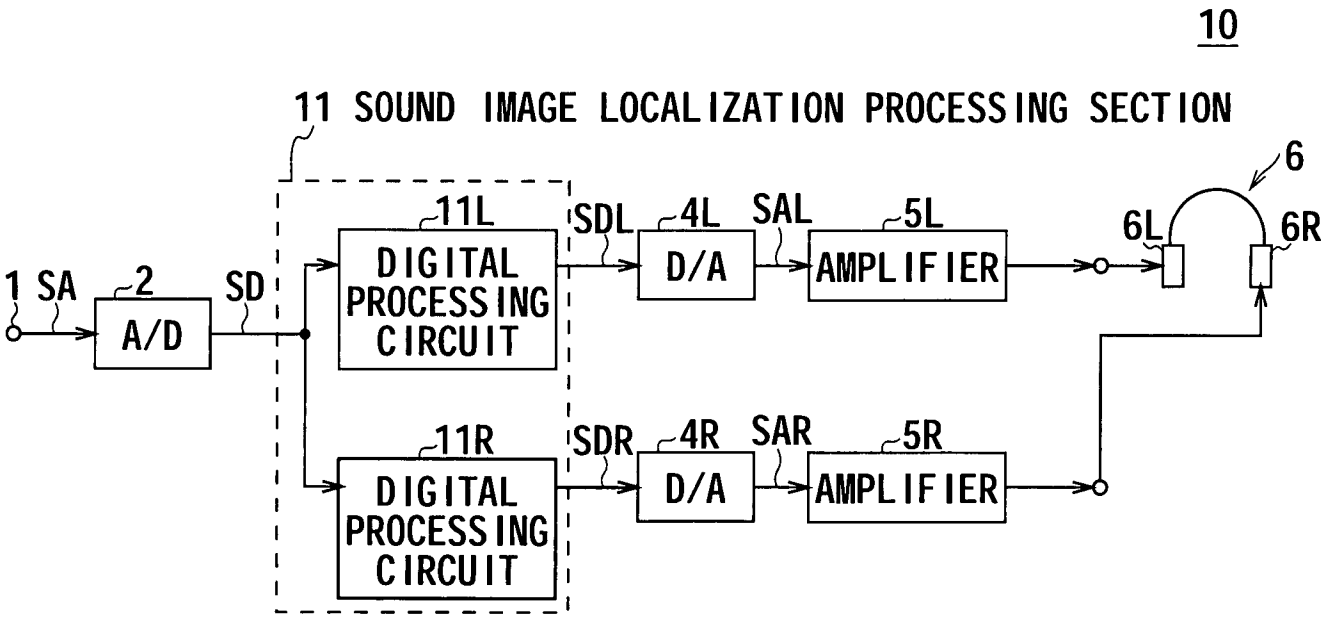
FIG. 6 is a block diagram showing the entire configuration of a headphone unit of a first embodiment.

In FIG. 6, in which sections common to FIG. 1 and FIG. 5 are given the same reference numerals, reference numeral 10 denotes a headphone unit of a first embodiment of the present invention, which is adapted to generate audio signals of n channels from an audio signal SA of one channel, localize each sound image at a different position and enable a listener to listen thereto.

Figure 7:
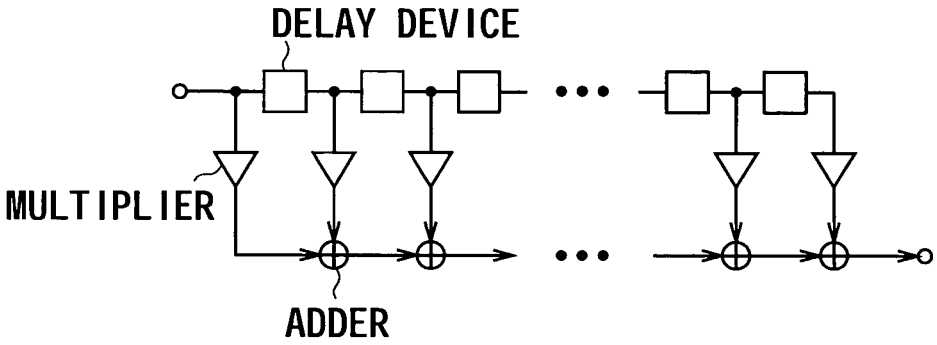
FIG. 7 is a block diagram showing the configuration of an FIR filter.

The headphone unit 10 as a sound image localization apparatus digitally converts the analog audio signal SA inputted via an input terminal 1, by an analog/digital conversion circuit 2 to generate a digital audio signal SD, and supplies it to a sound image localization processing section 11 which the present invention is characterized in. Digital signal processing circuits 11L and 11R of the sound image localization processing section 11 is configured by an FIR filter as shown in FIG. 7.

Figure 12:
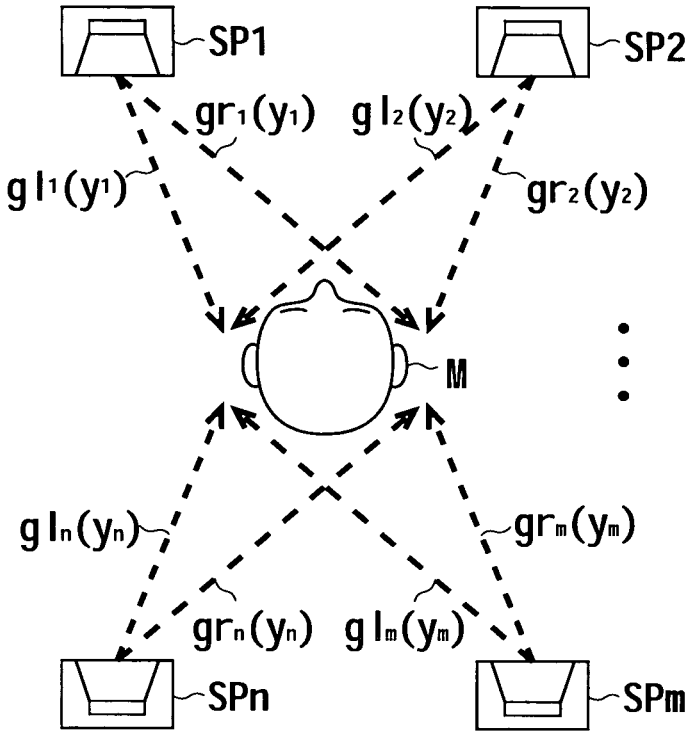
FIG. 12 is a schematic diagram to illustrate sound image localization by means of the headphone unit of the first embodiment.

The digital signal processing circuits 11L and 11R of the sound image localization processing section 11 performs uncorrelation processing and sound image localization processing to be described later on the digital audio signal SD to generate a left-channel audio signal SDL and a right-channel audio signal SDR, which cause n sound images to be localized at different sound source positions SP1 to SPn as shown in FIG. 12, and supplies the audio signals to subsequent-stage digital/analog conversion circuits 4L and 4R.

The digital/analog conversion circuits 4L and 4R analogously convert the audio signals SDL and SDR to generate analog audio signals SAL and SAR, respectively, amplify the analog audio signals by subsequent-stage amplifiers 5L and 5R, and supply them to a headphone 6. Acoustic units 6L and 6R of the headphone 6 convert the audio signals SAL and SAR to sounds, respectively, and output the sounds.

(1-2) Equivalence Processing by the Sound Image Localization Processing Section

Figure 8:
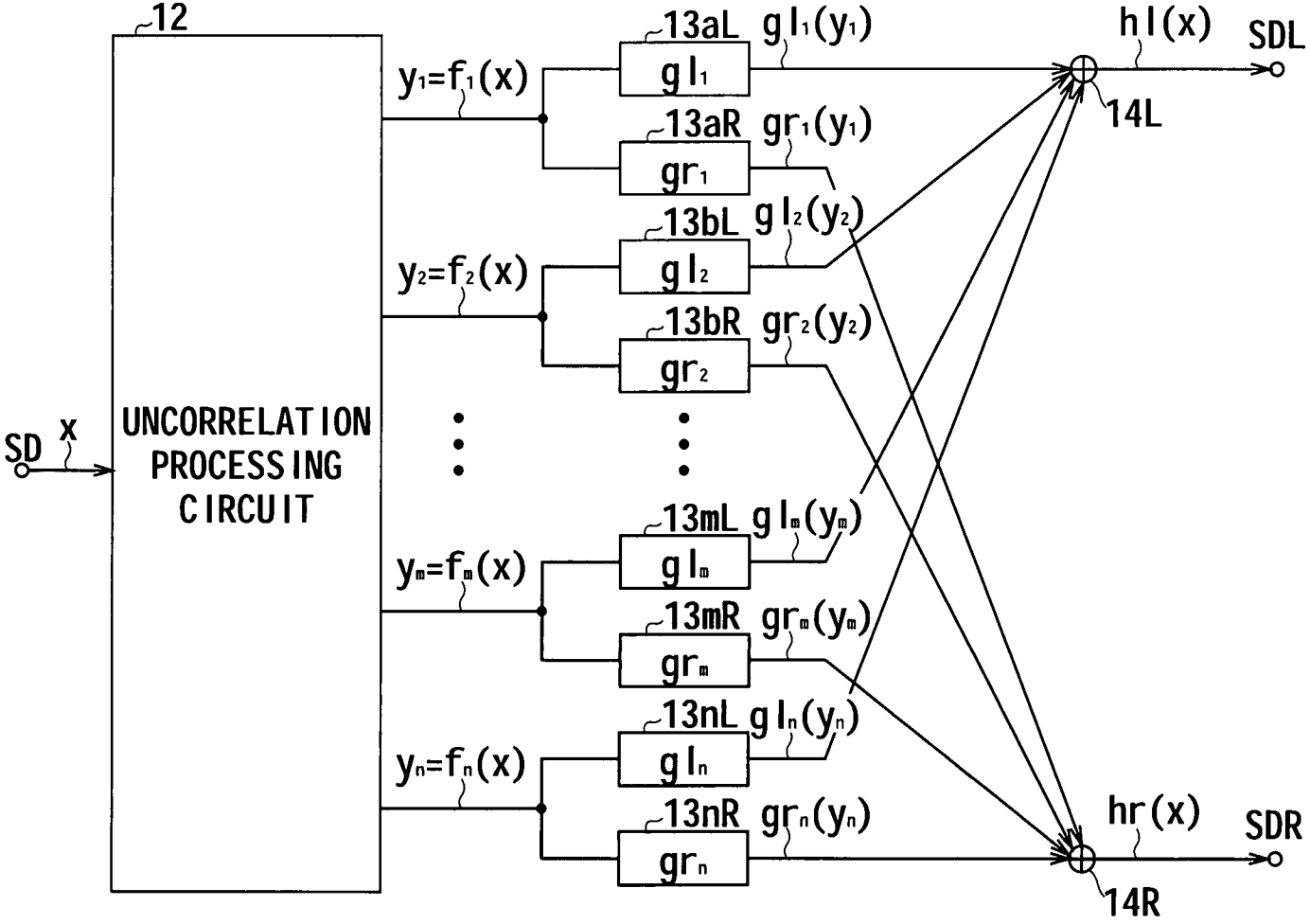
FIG. 8 is a block diagram showing the equivalence circuit of a sound image localization processing section of the first embodiment.

Next, description will be made on the processing to be performed by the sound image localization processing section 11, which the present invention is characterized in. The sound image localization processing section 11 performs processing equivalent to the processing shown in FIG. 8. First, based on predetermined transfer functions, an uncorrelation processing circuit 12 separates an inputted audio signal SD (referred to as an input signal x) into uncorrelated signals $y_1=f_1(x)$, $y_2=f_2(x)$, . . . $y_n=f_n(x)$ with low mutual correlation.

Figure 9:
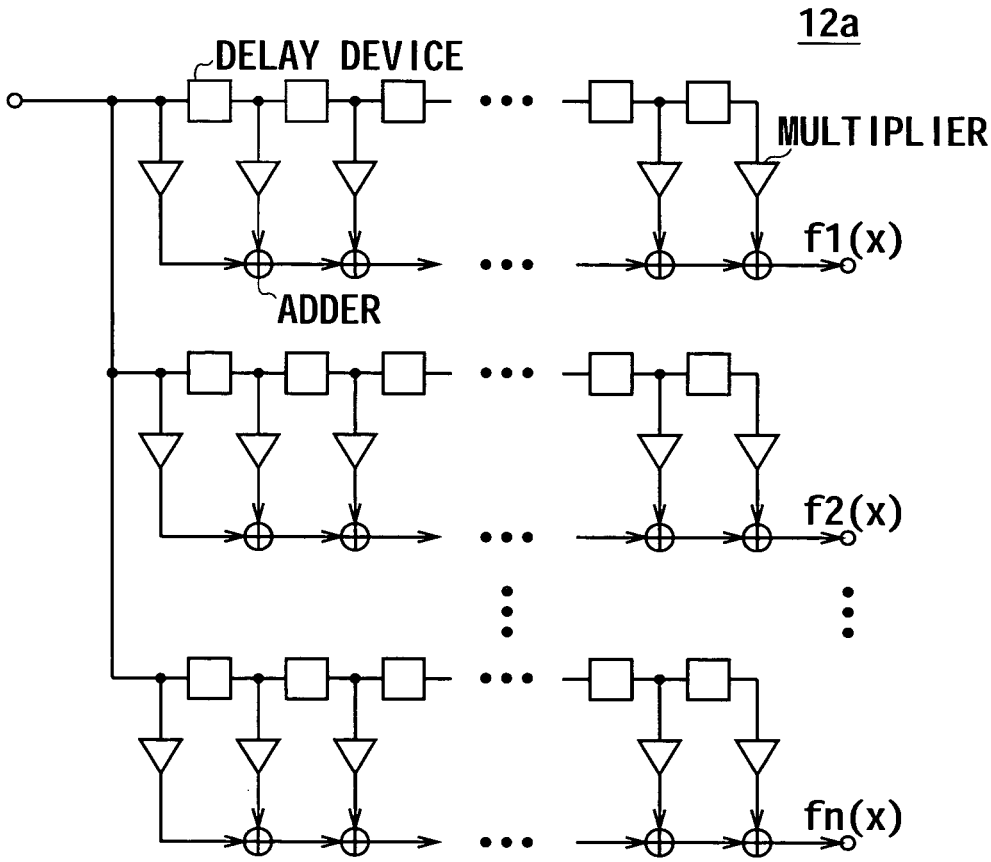
FIG. 9 is a block diagram showing the configuration of an uncorrelation processing circuit.
Figure 10:
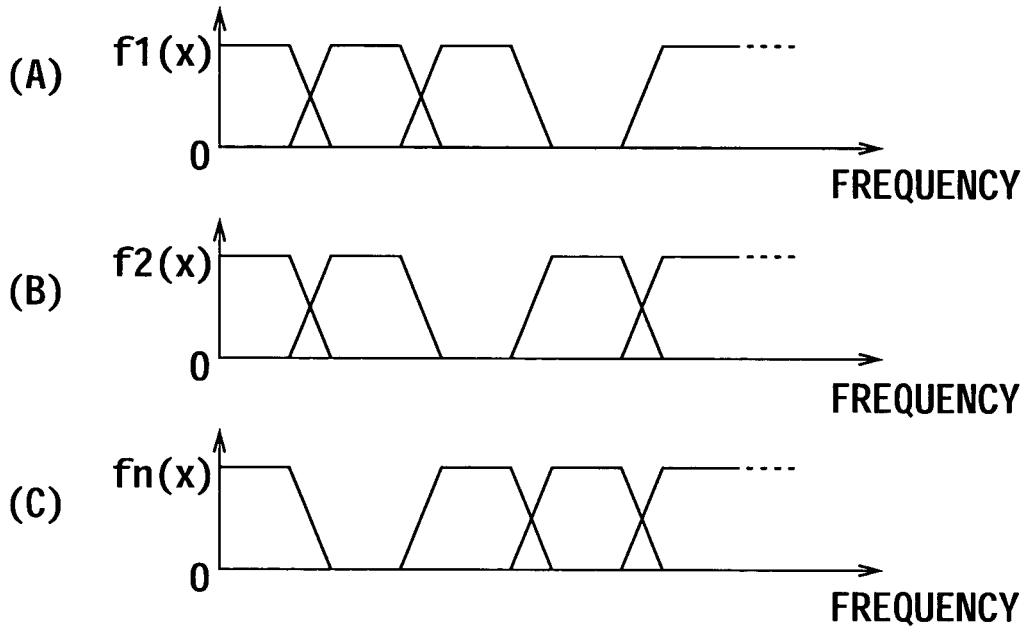
FIG. 10 is a schematic diagram showing an example of uncorrelation processing.
Figure 11:
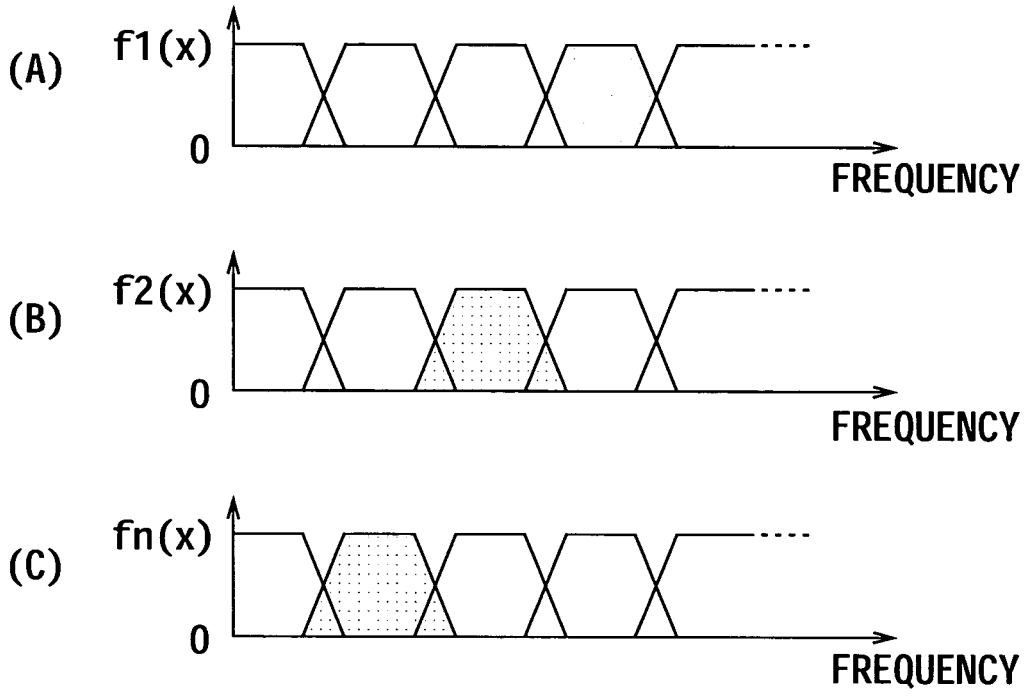
FIG. 11 is a schematic diagram showing an example of uncorrelation process.

The uncorrelation processing circuit 12 is configured by multiple FIR filters provided in parallel as shown in FIG. 9. Each FIR filter has characteristics uncorrelated with those of the other FIR filters. For example, as shown in FIG. 10, each FIR filter may have its specific blocking band. Alternatively, as shown in FIG. 11, each FIR filter may change a signal phase at its particular band.

The uncorrelated signals $y_1=f_1(x)$, $y_2=f_2(x)$, $y_n=f_n(x)$ separated from the input signal x in this way are inputted into subsequent-stage sound image localization filters 13*a*L and 13*a*R, 13*b*L and 13*b*R, . . . , and 13*n*L and 13*n*R, respectively, and processing for localization at a different sound image position is performed on each of them.

For example, by convoluting impulse responses of transfer functions $gl_1$ and $gr_1$ shown in FIG. 12 in the uncorrelated signal $y_1=f_1(x)$, the sound image localization filters 13*a*L and 13*a*R generate localization signals $gl_1(y_1)$ and $gr_1(y_1)$ which cause an image sound to be located at a sound source position SP1, and supply them to adders 14L and 14R, respectively.

Similarly, by convoluting impulse responses of transfer functions $gl_2$ and $gr_2$, . . . , $gl_n$ and $gr_n$ shown in FIG. 12 in the uncorrelated signals $y_2=f_2(x)$, . . . , $y_n=f_n(x)$, the sound image localization filters 13*b*L and 13*b*R, . . . , 13*n*L and 13*n*R generate localization signals $gl_2(y_2)$ and $gr_2(y_2)$, . . . , $gl_n(y_n)$ and $gr_n(y_n)$ which cause an image sound to be located at sound source positions SP2 SPn, respectively, and supply them to adders 14L and 14R.

The adder 14L synthesizes the localization signals $gl_1(y_1)$, $gl_2(y_2)$. $gl_n(y_n)$ to generate an output signal hl(x), and supplies it to the headphone 6 as a left-channel audio signal SDL via the digital/analog conversion circuit 4L and the amplifier 5L. Meanwhile, the adder 14R synthesizes the localization signals $gr_1(y_1)$, $gr_2(y_2)$ . . . $gr_n(y_n)$ to generate an output signal hr(x), and supplies it to the headphone 6 as a left-channel audio signal SDR via the digital/analog conversion circuit 4R and the amplifier 5R.

Thus, the headphone unit 10 can form a sound filed in which n sound images are localized at different positions from the inputted audio signal SA of one channel and enable the listener M to listen.

(1-3) Actual Processing by the Sound Image Localization Processing Section

Next, description will be made on the actual processing to be performed by the sound image localization processing section 11. The above-described output signals hl(x) and hr(x) outputted from the adders 14L and 14R are indicated by the following formulas, respectively.

$$hl(x)=gl_1(y_1)+gl_2(y_2)+\ldots+gl_n(y_n)$$

$$hr(x)=gr_1(y_1)+gr_2(y_2)+\ldots+gr_n(y_n) \quad (1)$$

Here, because of $y_1=f_1(x)$, $y_2=f_2(x)$, . . . $y_n=f_n(x)$, all of $y_1$, $y_2$ . . . $y_n$ are functions dependent on the input signal x, and therefore, the output signals hl(x) and hr(x) are also functions dependent on the input signal x.

The headphone unit 10 of the present invention utilizes this to generate the output signals hl(x) and hr(x) by one process by means of the digital signal processing circuits 11L and 11*r* each of which is configured by one FIR filter.

(1-4) Operation and Effect

In the above configuration, the sound image localization processing section 11 of the headphone unit 10 generates audio signals of n channels by performing uncorrelation processing on an audio signal SD. And, by further performing sound image localization processing, the sound image localization processing section 11 generates left-channel and right-channel audio signals SDL and SDR which cause n sound images to be localized at different sound source positions SP1 to SPn.

In this case, the headphone unit 10 integrally performs the above-described uncorrelation processing and sound image localization processing by means of the digital signal processing circuits 11L and 11R because all the audio signals of n channels are generated from the one audio signal SD.

Accordingly, the headphone unit 10 can generate the audio signals SDL and SDR constituting n independent sound images from the one audio signal SD only by being provided with the sound image localization processing sections 11L and 11*r* each of which is configured by an FIR filter.

According to the above configuration, the headphone unit 10 is adapted to perform uncorrelation processing and sound image localization processing on an audio signal SD by means of the pair of digital signal processing circuits 11L and 11*r*, and thereby, the headphone unit 10 capable of forming multiple independent sound images and enabling a user to listen thereto can be realized in a simple configuration.

(2) Second Embodiment (2-1) Entire Configuration of a Headphone Unit

Figure 13:
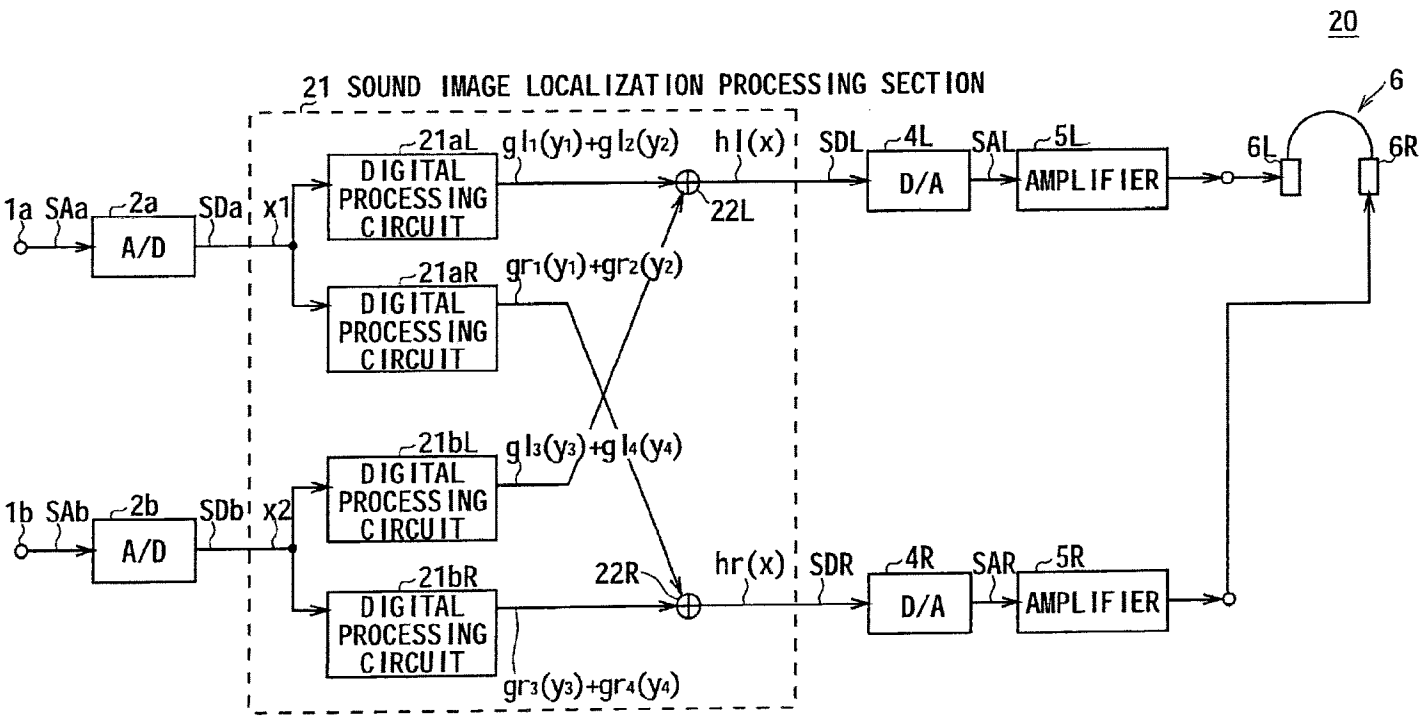
FIG. 13 is a block diagram showing the entire configuration of a headphone unit of a second embodiment.

In FIG. 13, in which sections common to FIG. 6 are given the same reference numerals, reference numeral 20 denotes a headphone unit of a second embodiment of the present invention, which is adapted to generate not only audio signals of two channels from an inputted audio signal SAa but also audio signals of two channels from an audio signal SAb, localize a total of four generated sound images at different positions and enable a listener to listen thereto.

The headphone unit 20 as a sound image localization apparatus digitally converts the analog audio signals SAa and SAb inputted via input terminals 1*a* and 1*b* by analog/digital conversion circuits 2*a* and 2*b* to generate digital audio signals SDa and SDb, respectively, and supplies them to a sound image localization processing section 21. Each of digital signal processing circuits 21*a*L, 21*a*R, 21*b*L and 21*b*R of the sound image localization processing section 21 is configured by an FIR filter as shown in FIG. 7.

After performing uncorrelation processing and sound image localization processing to be described later on the audio signals SDa and SDb by the digital signal processing circuits 21*a*L and 21*a*R, and 21*b*L and 21*a*R, the sound image localization processing section 21 synthesizes the audio signals by adders 22L and 22R as signal synthesis means to generate a left-channel audio signal SDL and a right-channel audio signal SDR which cause four sound images to be localized at different sound source positions SP1 to SP4, and supplies the audio signals to subsequent-stage digital/analog conversion circuits 4L and 4R.

The digital/analog conversion circuits 4L and 4R analogously convert the audio signals SDL and SDR to generate analog audio signals SAL and SAR, respectively, amplify the analog audio signals with subsequent-stage amplifiers 5L and 5R, and supply them to a headphone 6. Acoustic units 6L and 6R of the headphone 6 convert the audio signals SAL and SAR to sounds, respectively, and output the sounds.

(2-2) Equivalence Processing by the Sound Image Localization Processing Section

Next, description will be made on the processing to be performed by the sound image localization processing section 21. The sound image localization processing section 21 localizes two audio signals generated by performing uncorrelation processing on the audio signal SDa, at a left-forward sound source position SP1 and a left-back sound source position SP2 shown in FIG. 15, and localizes two audio signals generated by performing uncorrelation processing on the audio signal SDb, at a right-forward sound source position SP3 and a right-back sound source position SP4 shown in FIG. 15.

In this case, the sound image localization processing section 21 is adapted to integrally perform the uncorrelation processing and the sound image localization processing by means of the digital signal processing circuits 21*a*L and 21*a*R, and 2*b*L and 21*b*R each of which is configured by an FIR filter, similarly to the above-described sound image localization processing section 11 of the first embodiment.

Figure 14:
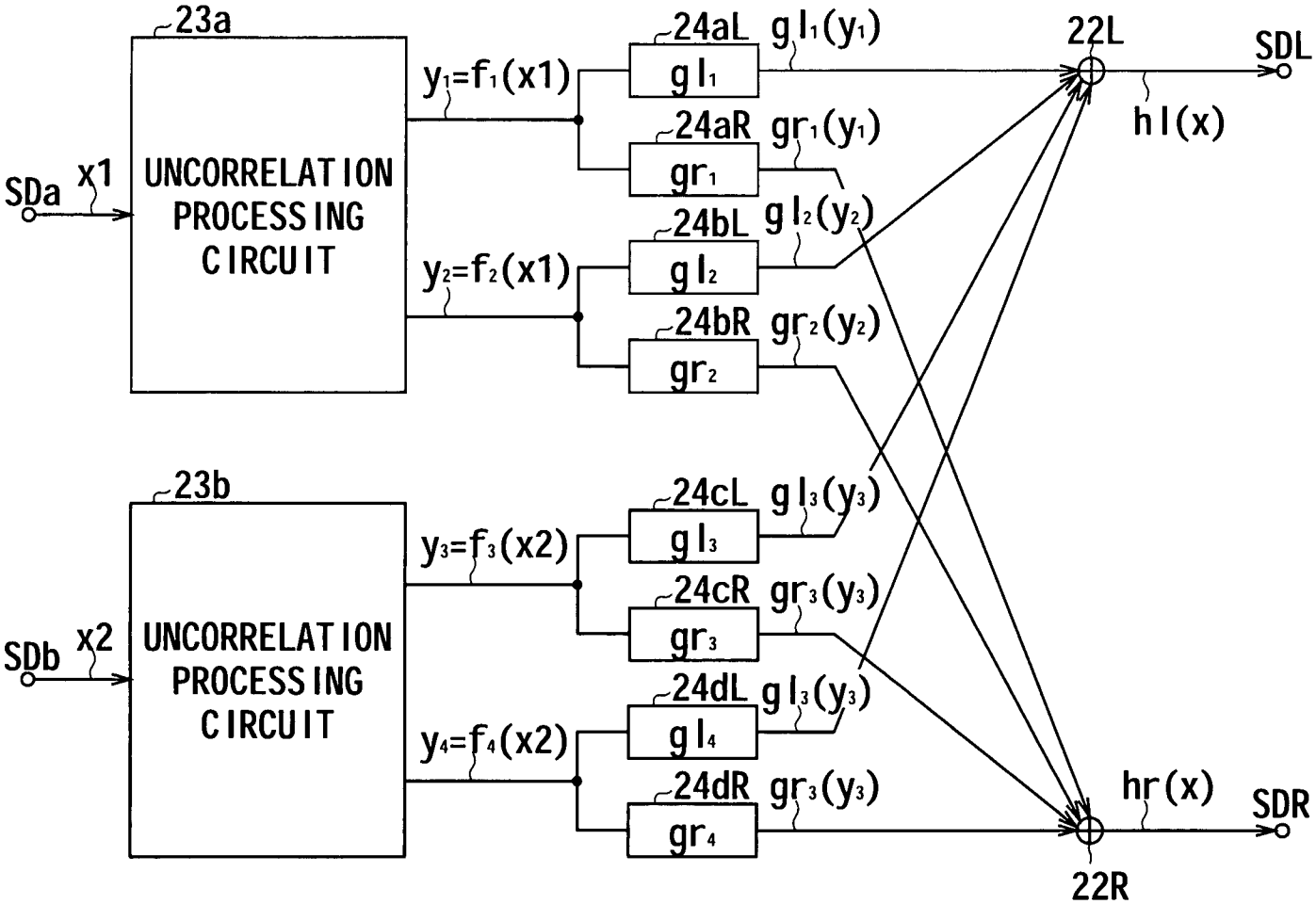
FIG. 14 is a block diagram showing the equivalence circuit of a sound image localization processing section of the second embodiment.

First, the equivalence processing to be performed by the sound image localization processing section 21 will be described with reference to FIG. 14. Based on predetermined transfer functions, an uncorrelation processing circuit 23*a* separates an inputted audio signal SDa (referred to as an input signal x1) into uncorrelated signals $y_1=f_1(x1)$ and $y_2=f_2(x1)$ with low mutual correlation.

The uncorrelated signals $y_1=f_1(x1)$ and $y_2=f_2(x1)$ separated from the audio signal SDa are inputted into subsequent-stage filters 24*a*L and 24*a*R, and 24*b*L and 24*b*R, respectively, and processing for localization at a different sound image position is performed for each of them.

Figure 15:
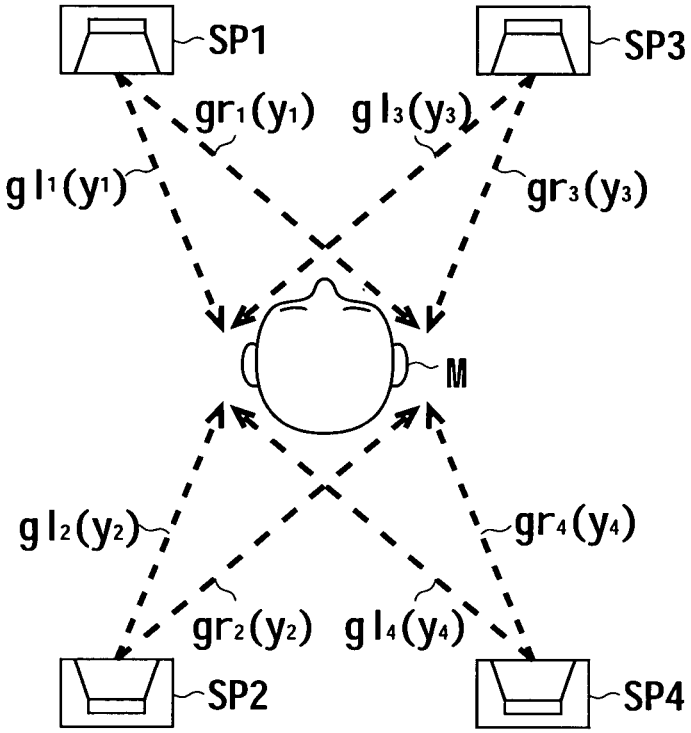
FIG. 15 is a schematic diagram to illustrate sound image localization by means of the headphone unit of the second embodiment.

That is, by convoluting impulse responses of transfer functions $gl_1$ and $gr_1$ shown in FIG. 15 in the uncorrelated signal $y_1=f_1(x1)$, the sound image localization filters 24*a*L and 24*a*R generate localization signals $gl_1(y_1)$ and $gr_1(y_1)$ which cause an image sound to be located at a sound source position SP1, and supply them to adders 25L and 25R, respectively.

Similarly, by convoluting impulse responses of transfer functions $gl_2$ and $gr_2$ shown in FIG. 15 in the uncorrelated signal $y_2=f_2(x_1)$, the sound image localization filters 24*b*L and 24*b*R generate localization signals $gl_2(y_2)$ and $gr_2(y_2)$ which cause an image sound to be located at a sound source position SP2, and supply them to adders 25L and 25R, respectively.

Meanwhile, based on predetermined transfer functions, an uncorrelation processing circuit 23*b* separates an inputted audio signal SDb (referred to as an input signal x2) into uncorrelated signals $y3=f_3(x2)$ and $y4=f_4(x2)$ with low mutual correlation.

The uncorrelated signals $y_3=f_3(x2)$ and $y_4=f_4(x2)$ separated from the audio signal SDb are inputted into subsequent-stage sound image localization filters 24*c*L and 24*c*R, and 24*d*L and 24*d*R, respectively, and processing for localization at a different sound image position is performed for each of them.

That is, by convoluting impulse responses of transfer functions $gl_3$ and $gr_3$ shown in FIG. 15 in the uncorrelated signal $y_3=f_3(x2)$, the sound image localization filters 24*c*L and 24*c*R generate localization signals $gl_3(y_3)$ and $gr_3(y_3)$ which cause an image sound to be located at a sound source position SP3, and supply them to adders 25L and 25R, respectively.

Similarly, by convoluting impulse responses of transfer functions $gl_4$ and $gr_4$ shown in FIG. 15 in the uncorrelated signal $y_4=f_4(x2)$, the sound image localization filters 24$d$L and 24$d$R generate localization signals $gl_4(y_4)$ and $gr_4(y_4)$ which cause an image sound to be located at a sound source position SP4, and supply them to adders 22L and 22R, respectively.

The adder 22L synthesizes the localization signals $gl_1(y_1)$, $gl_2(y_2)$, $gl_3(y_3)$ and $gl_4(y_4)$ to generate an output signal hl(x), and supplies it to the headphone 6 as a left-channel audio signal SDL via the digital/analog conversion circuit 4L and the amplifier 5L. The adder 22R synthesizes the localization signals $gr_1(y_1)$, $gr_2(y_2)$, $gr_3(y_3)$ and $gr_4(y_4)$ to generate an output signal hr(x), and supplies it to the headphone 6 as a right-channel audio signal SDR via the digital/analog conversion circuit 4L and the amplifier 5L.

Thus, the headphone unit 10 can form a sound filed in which four sound images are localized at different positions from the inputted audio signals SAa and SAb of two channels and enable the listener M to listen.

(2-3) Actual Processing by the Sound Image Localization Processing Section

Next, description will be made on the actual processing to be performed by the sound image localization processing section 21. The above-described output signals hl(x) and hr(x) outputted from the adders 14L and 14R are indicated by the following formulas, respectively.

$$hl(x)=gl_1(y_1)+gl_2(y_2)+gl_3(y_3)+gl_4(y_4)$$

$$hr(x)=gr_1(y_1)+gr_2(y_2)+gr_3(y_3)+gr_4(y_4) \quad (2)$$

Here, because of $y_1=f_1(x_1)$, $y_2=f_2(x1)$, $y_3=f_3(x2)$ and $y_4=f_4(x2)$, both of y1 and y2 are functions dependent on the input signal x1, and therefore, both of y3 and y4 are functions dependent on the input signal x2. Accordingly, the output signals hl(x) and hr(x) are functions dependent on the input signals x1 and x2.

The headphone unit 20 of this embodiment of the present invention utilizes this to generate the output signals hl(x) and hr(x) by means of the digital signal processing circuits 21$a$L and 21$a$R, and 21$b$L and 21$b$R each of which is configured by one FIR filter.

That is, the digital signal processing circuit 21$a$L generates a left-channel localization signal $gl_1(y_1)+gl_2(y_2)$ derived from an input signal x1 (namely, the audio signal SDa) and supplies it to the adder 22L. Meanwhile, the digital signal processing circuit 21$b$L generates a left-channel localization signal $gl_3(y_3)+gl_3(y_3)$ derived from an input signal x2 (namely, the audio signal SDb) and supplies them to the adder 22L.

The adder 22L adds the localization signals $gl_1(y_1)$, $gl_2(y_2)$, $gl_3(y_3)$ and $gl_3(y_3)$ to generate an output signal hl(x), and outputs this as a left-channel audio signal SDL.

The digital signal processing circuit 21$a$R generates a right-channel localization signal $gr_1(y_1)+gr_2(y_2)$ derived from the input signal x1 and supplies it to the adder 22R. Meanwhile, the digital signal processing circuit 21$b$R generates a right-channel localization signal $gr_3(y_3)+gr_3(y_3)$ derived from the input signal x2 and supplies them to the adder 22R.

The adder 22R adds the localization signals $gr_1(y_1)$, $gr_2(y_2)$, $gr_3(y_3)$ and $gr_3(y_3)$ to generate an output signal hr(x), and outputs this as a right-channel audio signal SDR.

(2-4) Operation and Effect

In the above configuration, the sound image localization processing section 21 of the headphone unit 20 generates a total of four audio signals by performing uncorrelation processing on audio signals SDa and SDb. And, by further performing sound image localization processing, the sound image localization processing section 21 generates left-channel and right-channel audio signals SDL and SDR which cause four sound images to be localized at different sound source positions SP1 to SP4.

In this case, the headphone unit 20 integrally performs the above-described uncorrelation processing and sound image localization processing by means of the two pairs of digital signal processing circuits 21$a$L and 21$a$R, and 2$b$L and 21$b$R because the audio signals of four channels are generated from the two audio signals SDa and SDb.

Accordingly, the headphone unit 20 can generate the audio signals SDL and SDR constituting four independent sound images from the two audio signals SDa and SDb only by being provided with the two pairs of digital signal processing circuits 21$a$L and 21$a$R, and 21$b$L and 21$b$R, each of the circuit being configured by an FIR filter.

According to the above configuration, the headphone unit 20 is adapted to perform uncorrelation processing and sound image localization processing on audio signals SDa and SDb by means of the two pairs of digital signal processing circuits 21$a$L and 21$a$R, and 21$b$L and 21$b$R, and thereby, the headphone unit 20 capable of forming multiple independent sound images and enabling a user to listen thereto can be realized in a simple configuration.

(3) Third Embodiment

Figure 16:
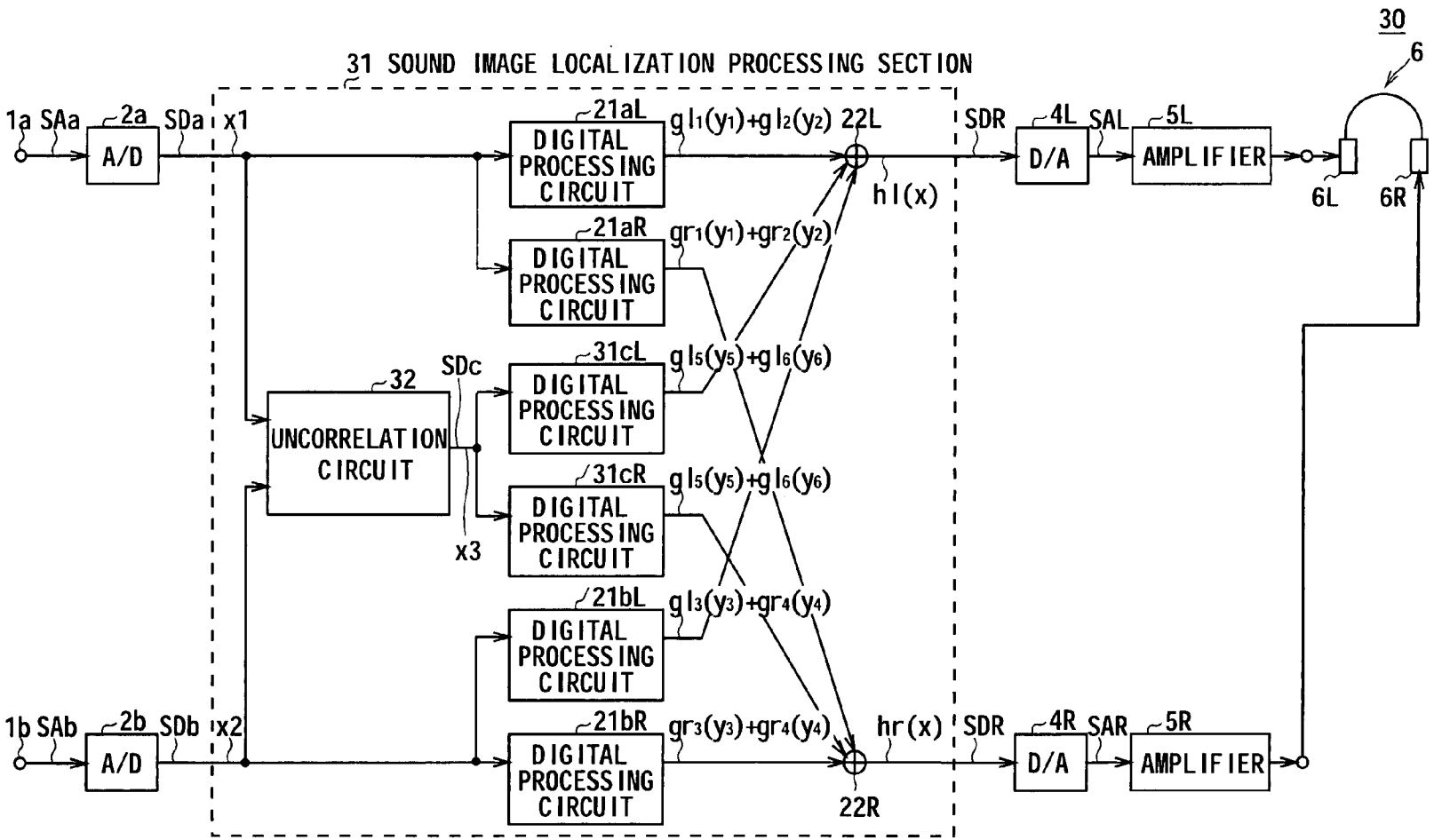
FIG. 16 is a block diagram showing the entire configuration of a headphone unit of a third embodiment.
Figure 18:
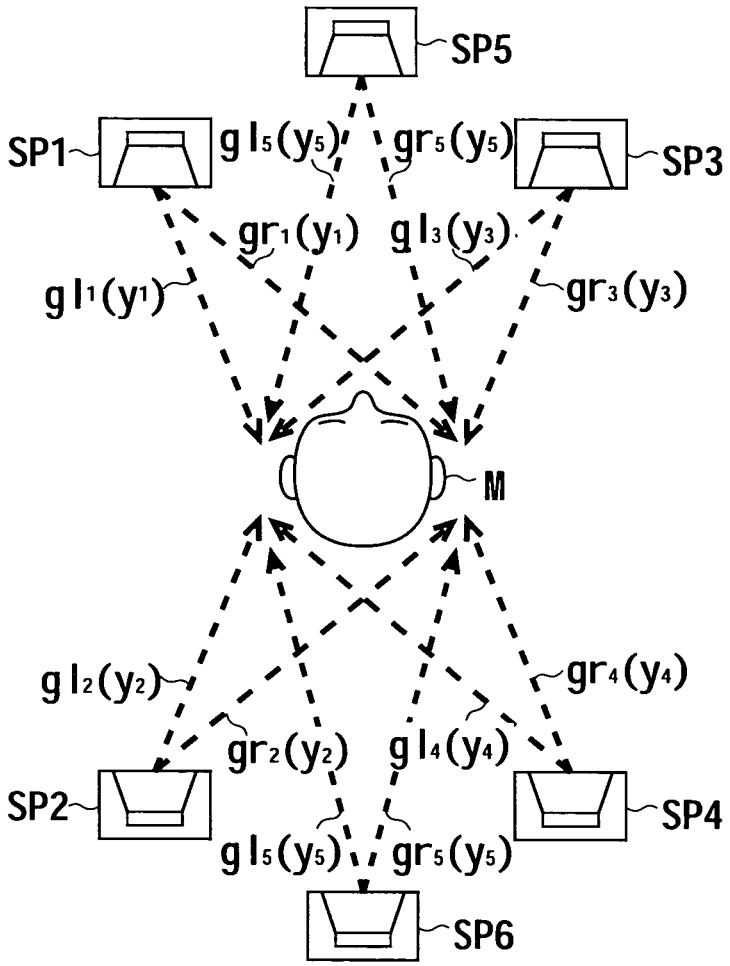
FIG. 18 is a schematic diagram to illustrate sound image localization by means of the headphone unit of the third embodiment.

In FIG. 16, in which sections common to FIG. 6 and FIG. 13 are given the same reference numerals, reference numeral 30 denotes a headphone unit of a third embodiment of the present invention, which is adapted to generate a new third audio signal SDc from audio signals SAa and SAb by means of a uncorrelation circuit 32 as audio signal generation means, in addition to generating audio signals of two channels from each of inputted audio signals SDa and SDb, similarly to the headphone unit 20 of the second embodiment, and further generate audio signals of two channels from the audio signal SDc to localize a total of sound images of six channels at different positions as shown in FIG. 18 and enable a listener to listen thereto.

Processing to be performed by digital signal processing circuits 21$a$L and 21$a$R, and 21$b$L and 21$b$R of a sound image localization processing section 31 are similar to that to be performed in the headphone unit 20 of the second embodiment, and therefore, description thereof is omitted. Description will be made only on digital signal processing circuits 31$c$L and 31$c$R which are newly added in this third embodiment.

Figure 17:
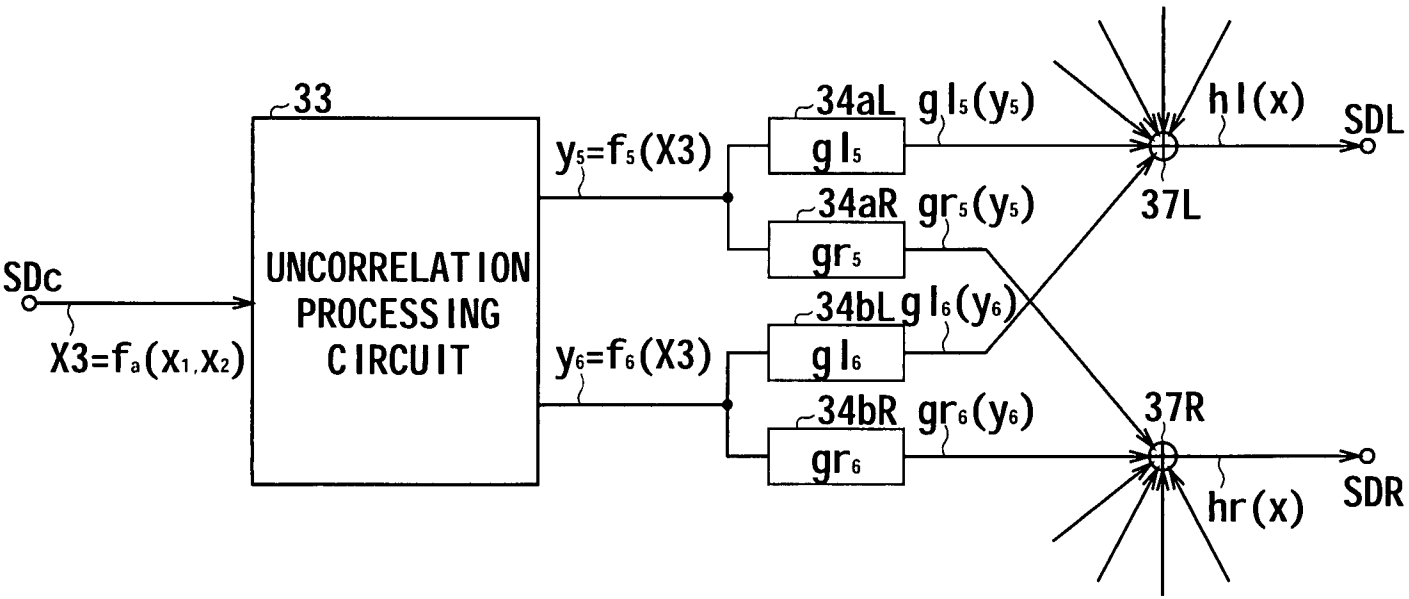
FIG. 17 is a block diagram showing the equivalence circuit of a sound image localization processing section of the third embodiment.

The equivalence processing to be performed by the digital signal processing circuits 31$c$L and 31$c$R will be described with reference to FIG. 17. Based on predetermined transfer functions, an uncorrelation processing circuit 33 separates an inputted audio signal SDc (referred to as an input signal x3) into uncorrelated signals $y_5=f_5(x3)$ and $y_6=f_6(x3)$ with low mutual correlation.

The separated uncorrelated signals $y_5=f_5(x3)$ and $y_6=f_6(x3)$ are inputted into subsequent-stage sound image localization filters 34$a$L and 34$a$R, 34$b$L and 34$b$R, respectively, and processing for localization at a different sound image position is performed on each of them.

That is, by convoluting impulse responses of transfer functions $gl_5$ and $gr_5$ shown in FIG. 18 in the uncorrelated signal $y_5=f_5(x3)$, the sound image localization filters 34$a$L and 34$a$R generate localization signals $gl_5(y5)$ and $gr_5(y_5)$ which cause a sound image to be located at a sound source position SP5, and supply them to adders 22L and 22R, respectively.

Similarly, by convoluting impulse responses of transfer functions $gl_6$ and $gr_6$ shown in FIG. 18 in the uncorrelated signal $y_6=f_6(x3)$, the sound image localization filters 34$b$L and 34$b$R generate localization signals $gl_6(y_6)$ and $gr_6(Y_6)$ which cause an image sound to be located at a sound source position SP6, and supply them to adders 22L and 22R, respectively.

The adder 22L synthesizes the localization signals $gl_1(y_1)$, $gl_2(y_2)$, $gl_3(y_3)$ and $gl_4(y_4)$ supplied from sound image localization filters 24$a$L, 24$b$L, 24$c$L and 24$d$L (not shown) and the localization signals $gl_5(y_5)$ and $gl_6(y_6)$ supplied from the sound image localization filters 34$a$L and 34$b$L to generate an output signal hl(x), and supplies it to the headphone 6 as a left-channel audio signal SDL to the headphone 6 via the digital/analog conversion circuit 4L and the amplifier 5L.

Meanwhile, the adder 22R synthesizes the localization signals $gr_1(y_1)$, $gr_2(y_2)$, $gr_3(y_3)$ and $gr_4(y_4)$ supplied from sound image localization filters 24$a$R, 24$b$R, 24$c$R and 24$d$R (not shown) and the localization signals $gr_5(y_5)$ and $gr_6(y_6)$ supplied from the sound image localization filters 34$a$R and 34$b$R to generate an output signal hr(x), and supplies it to the headphone 6 as a right-channel audio signal SDR via the digital/analog conversion circuit 4L and the amplifier 5L.

Thus, the headphone unit 10 can form a sound field in which six sound images are localized at different positions from the inputted audio signals SAa and SAb of two channels and enable the listener M to listen.

Here, because both of $y_5=f_5(x_3)$ and $y_6=f_6(x_3)$ are functions dependent on the input signal x3, the localization signals $gl_5(y_5)$ and $gl_6(y_6)$, and the localization signals $gr_5(y_5)$ and $gr_6(y_6)$ can be generated by means of one FIR filter, respectively.

Accordingly, the headphone unit 30 is adapted to generate the localization signals $gl_5(y_5)$ and $gl_6(y_6)$ by means of the digital signal processing circuit 31$c$L and generate the localization signals $gr_5(y_5)$ and $gr_6(y_6)$ by means of the digital signal processing circuit 31$c$R.

In the above configuration, the sound image localization processing section 31 of the headphone unit 30 not only generates a total of audio signals of four channels by performing uncorrelation processing on each of the audio signals SDa and SDb but also generates audio signals of two channels by performing uncorrelation processing on an audio signal SDc newly generated from the audio signals SDa and SDb. And, by further performing sound image localization, the sound image localization processing section 31 generates left-channel and right-channel audio signals SDL and SDR which cause six sound images to be localized at different sound source positions SP1 to SP6.

In this case, the headphone unit 30 integrally performs the uncorrelation processing and sound image localization processing for generating audio signals of four channels from the audio signals SDa and SDb by means of the two pairs of digital signal processing circuits 21$a$L and 21$a$R, and 2$b$L and 21$b$R, and at the same time, integrally performs the uncorrelation processing and sound image localization processing for generating audio signals of two channels from the audio signals SDc by means of the one pair of digital signal processing circuits 31$c$L and 31$c$R.

Accordingly, the headphone unit 30 can generate the audio signals SDL and SDR constituting six independent sound images from the two audio signals SDa and SDb only by being provided with the three pairs of digital signal processing circuits 21$a$L and 21$a$R, 21$b$L and 21$b$R, and 31$c$L and 31$c$R, each of the circuit being configured by an FIR filter.

According to the above configuration, the headphone unit 30 is adapted to perform uncorrelation processing and sound image localization processing on audio signals SDa and SDb by means of the three pairs of digital signal processing circuits 21$a$L and 21$a$R, 21$b$L and 21$b$R, and 31$c$L and 31$c$R, and thereby, the headphone unit 30 capable of forming multiple independent sound images and enabling a user to listen thereto can be realized in a simple configuration.

(4) Other Embodiments

Though, description has been made on a case where the present invention is applied to a headphone unit for localizing a sound image outside the head in the above first to third embodiments, the present invention is not limited thereto. The present invention can be applied to a speaker unit for localizing a sound image at a given position.

Furthermore, though a sequence of signal processings for performing uncorrelation and sound image localization on an audio signal is executed by hardware such as a digital processing circuit in the above first to third embodiments, the present invention is not limited thereto. The sequence of signal processings may be performed by a signal processing program to be executed on information processing means such as a DSP (digital signal processor).

Figure 19:
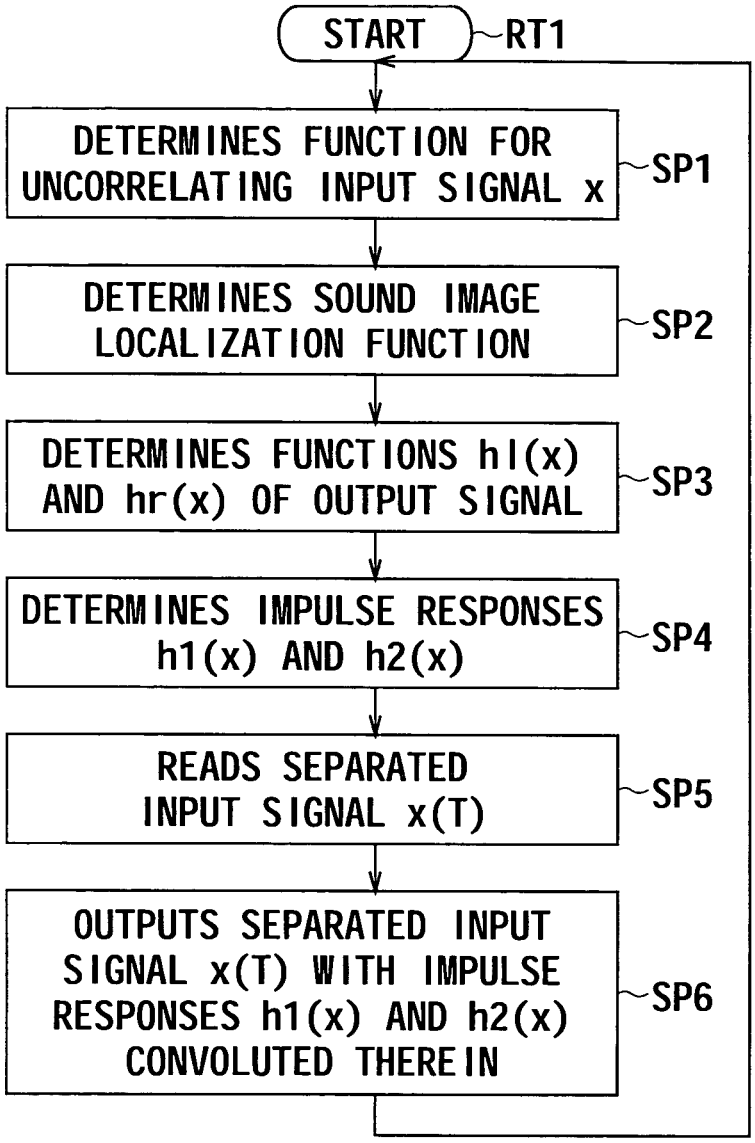
FIG. 19 is a flowchart of a sound image localization processing procedure.

As an example of such a signal processing program, a sound image localization processing program for performing signal processing corresponding to that of the headphone unit 10 of the first embodiment will be described with the use of a flowchart shown in FIG. 19. First, headphone-unit information processing means starts from a start step of a sound image localization processing procedure routine RT1 and proceeds to step SP1, where it determines functions $y_1=f_1(x)$, $y_2=f_2(x)$, . . . $y_n=f_n(x)$ for separating an input signal x into signals which are uncorrelated with one another. Then, the headphone-unit information processing means proceeds to the next step SP2.

At step SP2, the headphone-unit information processing means determines sound source localization functions $gl_1(y_1)$ and $gr_1(y_1)$, $gl_2(y_2)$ and $gr_2(y_2)$, . . . , $gl_n(y_n)$ and $gr_n(y_n)$ based on transfer functions from a sound source to a listener's ears, and proceeds to the next step SP3.

At step SP3, the headphone-unit information processing means determines output signal functions $hl(x)=gl_1(y_1)+gl_2(y_2)+\ldots+gl_n(y_n)$ and $h_r(x_1)=gr_1(y_1)+gr_2(y_2)+\ldots+gr_n(y_n)$, and proceeds to the next step SP4.

At step SP4, the headphone-unit information processing means calculates impulse responses h1($t$) and h2($t$) which realize the output signal functions h1($x$) and hr(x), and proceeds to the next step SP5.

At step SP5, the headphone-unit information processing means reads a separated input signal x(t), which is the input signal x separated by predetermined time intervals, and proceeds to the next step SP6.

At step SP6, the headphone-unit information processing means convolutes the above-described impulse responses h1($t$) and h2($t$) in an input signal $x_0(t)$ and outputs the result as left-channel and right-channel audio signals SDL and SDR, and returns to step SP1.

In this way, even when uncorrelation processing and sound image localization processing are performed by means of a program, it is also possible to reduce processing load of the uncorrelation processing and the sound image localization processing by integrally handling a function for uncorrelating the input signal x, a sound source localization function and the like as output signal functions hl(x) and hr(x), and convoluting the impulse responses h1($t$) and h2($t$) based thereon in the input signal x.

The present invention can be applied for the purpose of localizing a sound image of an audio signal at a given position.

It should be understood by those skilled in the art that various modifications, combinations, sub-combinations and alterations may occur depending on design requirements and other factors insofar as they are within the scope of the appended claims or the equivalents thereof.

What is claimed is:

1. A sound image localization apparatus, comprising signal processing means comprising:

means for separating an input single channel audio signal, by using an uncorrelation function, into a plurality of uncorrelated audio signals with low mutual correlation; and means for performing a sound image localization function for localizing a sound image of each of the plurality of uncorrelated audio signals at an adjustable sound source position, the adjustable sound source positions of the respective uncorrelated audio signals being different, such that left-channel and right-channel audio signals are generated for reproduction, wherein the means for performing a sound image localization function is to convolve each of the plurality of uncorrelated audio signals with left channel and right channel impulse responses of respective left and right transfer functions of left and right paths from the respective adjustable sound source position to left and right ears of a listener, to generate left channel and right channel localization signals for each of N different sound source positions and convertible into left and right sounds outputs which, when outputted respectively at the left and right ears of the listener, localize N sound images associated with the left and right sound outputs at the respective N different sound source positions, such that the N sound images are provided only by N Finite Impulse Response (FIR) filters.

2. The sound image localization apparatus according to claim 1, wherein the signal processing means is configured by a pair of Finite Impulse Response (FIR) filters.

3. The sound image localization apparatus according to claim 1, wherein the signal processing means comprises a plurality of the signal processing means; and further comprising signal synthesis means for synthesizing left-channel and right-channel audio signals for reproduction outputted from the plurality of signal processing means, respectively.

4. A sound image localization method for use with a sound image localization apparatus, said method comprising:

an uncorrelation function determination step of determining an uncorrelation function and of separating an input single channel audio signal by use of the uncorrelation function into a plurality of uncorrelated audio signals with low mutual correlation by use of a processing circuit;

a sound image localization determination step of determining a sound image localization function for localizing a sound image of each of the plurality of uncorrelated audio signals at an adjustable sound source position, the adjustable sound source positions of the respective uncorrelated audio signals being different, wherein the sound image localization determination step is to convolve each of the plurality of uncorrelated audio signals with left channel and right channel impulse responses of respective left and right transfer functions of left and right paths from the respective adjustable sound source position to left and right ears of a listener, to generate left channel and right channel localizations signals for each of N different sound source positions and convertible into left and right sounds outputs which, when outputted respectively at the left and right ears of the listener, localize N sound images associated with the left and right sound outputs at the respective N different sound source positions, are integrated and configured such that the N sound images are provided only by N Finite Impulse Response (FIR) filters; and a reproduction audio signal generation step of generating left-channel and right-channel audio signals for reproduction by performing signal processing on the input audio signal by using the left channel and right channel localization signals.

5. A sound image localization apparatus, comprising:

a signal processing circuit comprising:

a separating circuit to separate an input single channel audio signal based on a number of predetermined transfer functions into a plurality of uncorrelated audio signals with low mutual correlation; and a sound image localization circuit to receive the plurality of uncorrelated audio signals from the signal processing circuit and to perform a localization processing to localize a sound image of each of the plurality of uncorrelated audio signals at an adjustable sound source position, the adjustable sound source positions of the respective uncorrelated audio signals being different, so as to generate a left-channel audio signal and a right-channel audio signal, in which the sound image localization circuit includes a plurality of pairs of left channel and right channel sound image localization filters, wherein each of the pairs of left channel and right channel sound image localization filters is to convolve the respective uncorrelated audio signal with left channel and right channel impulse responses of respective left and right transfer functions of left and right paths from the respective adjustable sound source position to left and right ears of a listener, to generate left channel and right channel localization signals for each of N different sound source positions and convertible into left and right sounds outputs which, when outputted respectively at the left and right ears of the listener, localize N sound images associated with the left and right sound outputs at the respective N different sound source positions, such that the N sound images are provided only by N Finite Impulse Response (FIR) filters, in which each of the FIR filters of the signal processing circuit has a characteristic associated therewith which is uncorrelated with a characteristic of other of the FIR filters.

6. The sound image localization apparatus according to claim 5, in which the sound image localization circuit includes left channel and right channel adders to receive, respectively, the left channel and right channel localization signals and to generate the left-channel audio signal and the right-channel audio signal therefrom.

7. The sound image localization apparatus according to claim 5, in which said each FIR filter of said signal processing circuit has a specific blocking band.

8. The sound image localization apparatus according to claim 5, in which said each FIR filter of said signal processing circuit changes signal phase at its particular band.

* * * * *